US006145504A

United States Patent [19]

Miyake

[11] Patent Number: 6,145,504

[45] Date of Patent: Nov. 14, 2000

[54] MASK FOR PREVENTING PERMEATION OF FOREIGN MATERIAL

[75] Inventor: Kaoru Miyake, Shizuoka, Japan

[73] Assignee: San-M Packaging Co., Ltd., Shizouka, Japan

[21] Appl. No.: 09/141,340

[22] Filed: Aug. 27, 1998

[30] Foreign Application Priority Data

Jun. 16, 1998 [JP] Japan ..... 10-167979

[51] Int. Cl.[7] ..... A62B 18/02

[52] U.S. Cl. ..... 128/206.19; 128/206.21; 128/206.22

[58] Field of Search ..... 128/206.19, 206.12, 128/206.22, 206.13, 206.21

[56] References Cited

U.S. PATENT DOCUMENTS 4,920,960 5/1990 Hubbard et al. ..... 128/206.12

5,699,791 12/1997 Sukiennik et al. .

FOREIGN PATENT DOCUMENTS 363162011 7/1988 Japan .

*Primary Examiner*—Michael A. Brown
*Assistant Examiner*—Lalita Hamilton
*Attorney, Agent, or Firm*—Kanesaka & Takeuchi

[57] ABSTRACT

A mask for preventing passage of a liquid type foreign material of the invention is formed of a liquid absorbing layer for absorbing the liquid type foreign material applied thereto, and a liquid transmission prevention layer disposed on the liquid absorbing layer at a downstream side of air flowing through the mask. The liquid transmission prevention layer prevents the liquid type foreign material, such as humor, absorbed by the liquid absorbing layer from contacting a wearer.

4 Claims, 2 Drawing Sheets

MASK FOR PREVENTING PERMEATION OF FOREIGN MATERIAL

BACKGROUND OF THE INVENTION AND RELATED ART STATEMENT

The present invention relates to a mask, and more particularly, a mask for preventing liquid type foreign material from permeating.

As generally known, when a doctor or a dentist conducts an operation or medical examination, a mask is used to cover his or her mouth and nose so as not to breathe upon a patient as well as to prevent humor, such as blood or secretion, which might be dispersed from the patient, from accidentally contacting the doctor's or dentist's mouth and nose. However, in the conventional mask, in case of the operation or the medical examination, when the humor such as blood or secretion accidentally contacts the mask covering the mouth and nose of the doctor or the dentist, the humor permeates through the mask, and contacts the mouth and nose of the doctor and dentist. Thus, the conventional mask has a problem that the mask can not perfectly prevent incident that doctors and dentists, who conduct operation or medical examination, are infected from the patient's humor.

The present invention has been made to obviate the problems of the conventional mask.

An object of the invention is to provide a mask which prevents liquid type foreign material attached to the mask from completely passing or penetrating therethrough.

Another object of the invention is to provide a mask as stated above, wherein the liquid type foreign material, such as humor, dispersed on a front surface of the mask from permeating to a mouth of a person wearing the mask, to thereby prevent infection from the humor of the patient.

A further object of the invention is to provide a mask as stated above, which can provide easy breathing to a wearer.

Further objects and advantages of the invention will be apparent from the following description of the invention.

SUMMARY OF THE INVENTION

To achieve the above objects, the present invention provides a mask formed of a liquid absorbing layer for absorbing a liquid type foreign material, such as humor, spread or attached thereto, and a liquid transmission prevention layer disposed on the liquid absorbing layer at a downstream side of air flowing through the mask. In the mask, the liquid transmission prevention layer prevents the liquid type foreign material absorbed by the liquid absorbing layer from contacting a wearer.

The liquid absorbing layer is formed of fibers having an average diameter from 1.0 $\mu$m to 2.0 $\mu$m, a weight per area from 15 g/m$^2$ to 25 g/m$^2$, and a space in a cubic unit of 90% or more.

Preferably, the liquid absorbing layer may be formed of fibers having an average diameter from 1.0 $\mu$m to 2.0 $\mu$m, a weight per area from 15 g/m$^2$ to 25 g/m$^2$, a thickness from 0.2 mm to 0.5 mm, and a space in a cubic unit from 90% to 98%.

The liquid transmission prevention layer may be formed of a gigged non-woven fabric having a number of gigged hairs at a side of the liquid absorbing layer.

In case the gigged non-woven fabric is used as the liquid transmission prevention layer, the gigged hairs of the liquid transmission prevention layer contact the liquid absorbing layer so as to reduce an area of contact of the liquid transmission prevention layer with the liquid absorbing layer. Accordingly, the liquid type foreign material absorbed in the liquid absorbing layer is prevented from substantially permeating into the liquid transmission prevention layer.

In addition, the mask may be formed of four layers. In other words, the mask having the above two layers may include two more layers, i.e., a first layer disposed on a front surface of the liquid absorbing layer at a side away from the wearer, and a second layer disposed on the liquid transmission prevention layer and directly contacting the wearer. The first layer and the second layer further enhance the ability of preventing the liquid type foreign material from permeating and flowing to the mouth.

DETAILED DESCRIPTION OF PREFERRED EMBODIMENTS

Figure 1:
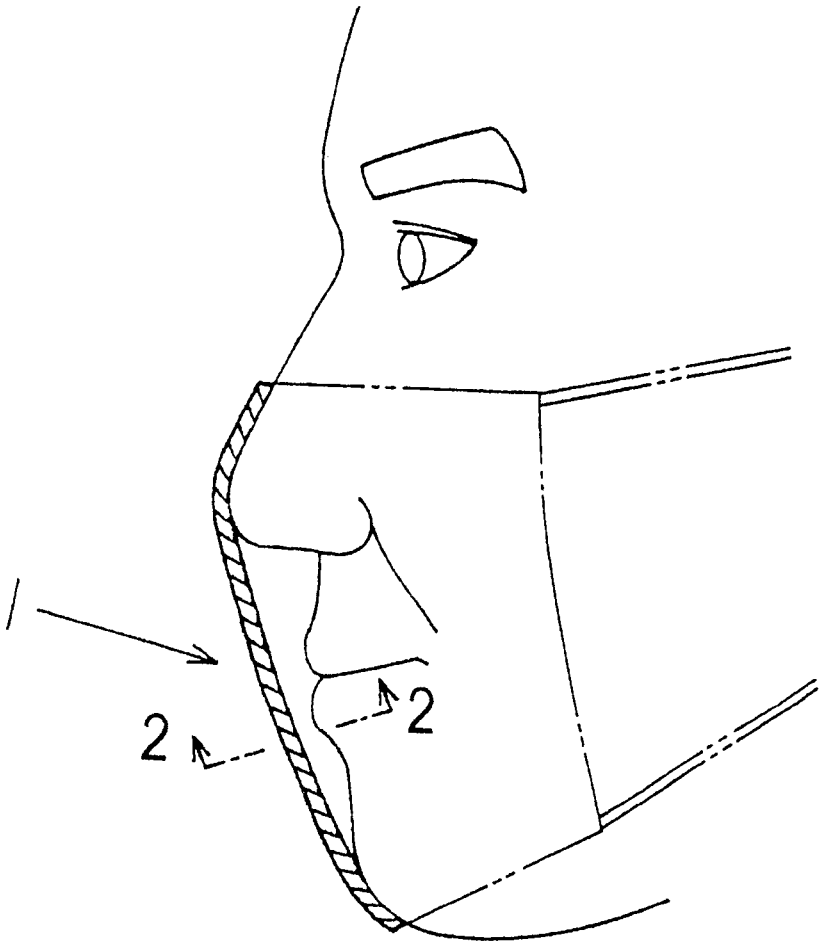
FIG. 1 is a partly sectional schematic view showing a condition that a mask of an embodiment according to the present invention is worn.
Figure 2:
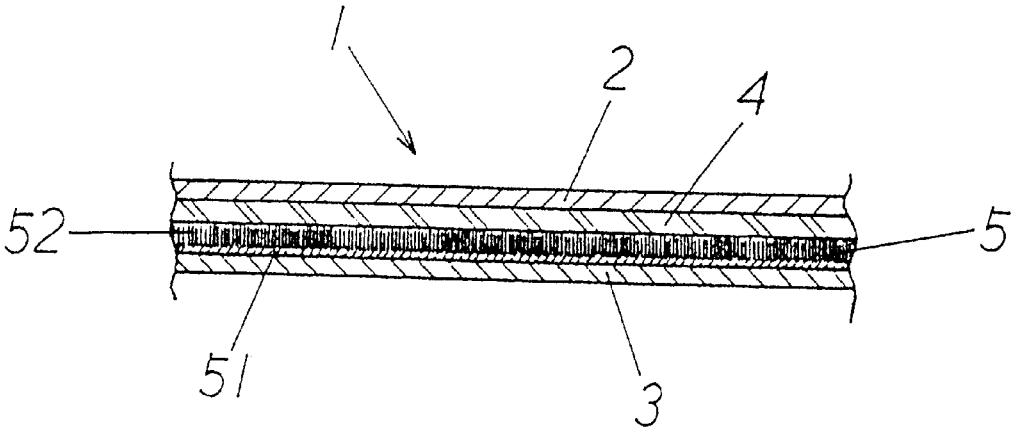
FIG. 2 is an enlarged sectional view taken along line 2—2 in FIG. 1.
Figure 3:
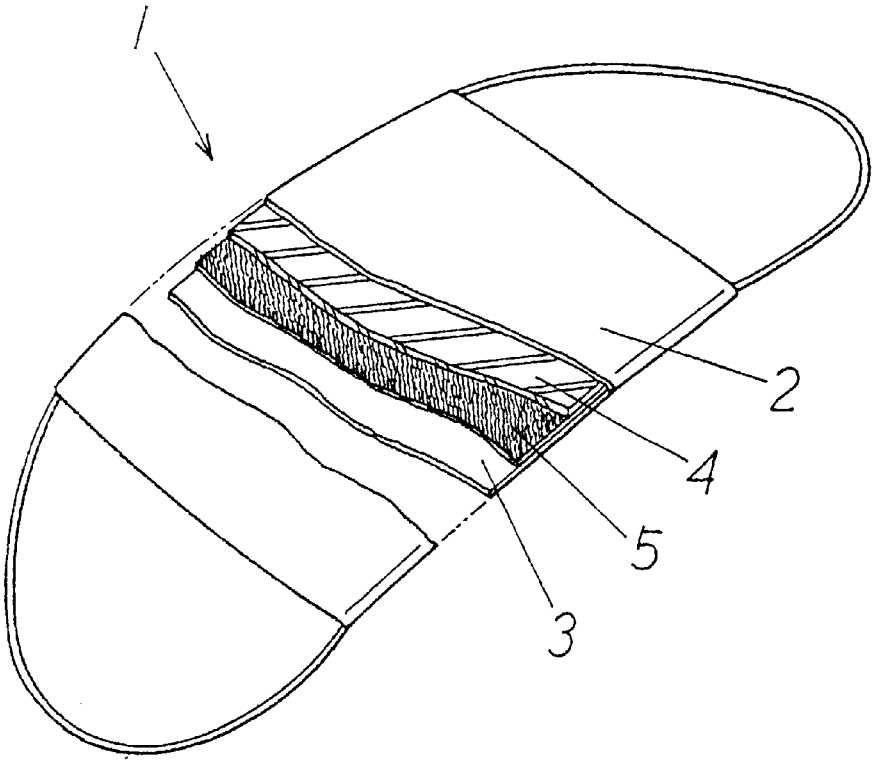
FIG. 3 is a schematic explanatory view of the mask shown in FIG. 1, wherein layers of the mask are partly cut.

A mask of an embodiment of the present invention will be explained by referring to the attached drawings. In FIG. 1 through FIG. 3, numeral 1 designates a mask for removing a dust and liquid type foreign material contained in inhaled air. The mask 1 has a rectangular shape and air permeability, and is formed of, for example, four layers.

Numeral 2 designates a first layer or front side cover disposed away from a mouth of a wearer, and numeral 3 designates a second layer or mouth side cover located adjacent to the mouth.

Between the first layer 2 and the second layer 3, there are disposed a liquid absorbing layer 4 for absorbing liquid, such as humor, e.g. blood or secretion, and a liquid transmission prevention layer 5 for preventing the liquid absorbed in the liquid absorbing layer 4 from flowing or permeating to the mouth.

The liquid absorbing layer 4 is formed of very thin fibers to have a bulky and airy condition. For example, it is formed of a melt-blow non-woven fabric, e.g. polypropylene, which is made by so called melt-blow method, wherein molten resin blown by hot air when being pushed out from a spinning port is collected on a conveyer to form a web. More specifically, the non-woven fabric has an average diameter from 1.0 $\mu$m to 2.0 $\mu$m, a weight per area from 15 g/m$^2$ to 25 g/m$^2$, a thickness from 0.2 mm to 0.5 mm, and a space in a cubic unit of 90% or more, e.g. from 90% to 98%. As compared to other fabrics having the same weight per area (g/m$^2$), this non-woven fabric forming the liquid absorbing layer 4 has more space in the cubic unit, and the fibers constituting the fabric are thinner and a number thereof is higher. Therefore, by making meshes of the fabric finer and more porous, an ability of retaining the liquid or humor can be improved.

The liquid transmission prevention layer 5, which is disposed on a downstream side of the liquid absorbing layer 4 with respect to the flow of the inhaled air, is formed of, for example, a gigged non-woven material, and more specifically, a gigged non-woven fabric made of bicomponent fibers, whose main material is polypropylene. The gigged non-woven fabric constituting the liquid transmission prevention layer 5 includes a large number of gigged hairs 52 which are formed by gigging one surface of a base fabric 51 by hot air.

Accordingly, even if a liquid including humor, such as a blood or secretion, is dispersed onto the mask 1, the liquid is absorbed by the liquid absorbing layer 4, and the absorbed liquid is blocked by the liquid transmission prevention layer 5. Thus, the liquid or humor can be prevented from contacting the wearer, such as doctor or the dentist who wears the mask 1 and conducts the medical examination or operation.

Especially, since the liquid absorbing layer 4 is formed of very fine fibers and includes more space in the cubic unit, an ability of absorbing and retaining a liquid by the liquid absorbing layer 4 is increased, and the liquid absorbing layer 4 can be formed thin. Also, it is possible to reduce a contact area when the gigged hairs of the gigged non-woven fabric contact the liquid absorbing layer 4. Namely, when the liquid absorbing layer 4, which has high liquid absorbing and retaining ability and is made thin, is in a substantial point contact with the liquid transmission prevention layer 5, the liquid or humor absorbed by the liquid absorbing layer 4 is blocked by the liquid transmission prevention layer 5 or does not permeate or flow to the liquid transmission prevention layer 5. Thus, permeation of the liquid or humor can be prevented even by the thin gigged non-woven fabric, and the mask as a whole can be formed thin.

Also, if the liquid transmission prevention layer 5 is formed of a gigged non-woven fabric in which the mesh between the gigged fibers is large, air resistance passing through the liquid transmission prevention layer 5 is not so high. Thus, when the wearer breathes through the mask, the wearer does not feel choking.

Incidentally, although the mask 1 is formed by four layers consisting of the first layer or front side cover 2, the second layer or mouth side cover 3, the liquid absorbing layer 4, and the liquid transmission prevention layer 5 in the aforementioned embodiment, the present invention is not limited to this structure, and the mask can be constituted by two layers formed of the liquid absorbing layer 4 and the liquid transmission prevention layer 5. Also, other than the four layers including the first layer 2, the second layer 3, the liquid absorbing layer 4 and the liquid transmission prevention layer 5, permeable layers (not shown in the figures) can be provided between the first layer 2 and the liquid absorbing layer 4, and between the liquid transmission prevention layer 5 and the second layer 3.

In short, the mask 1 of the present invention should at least include the liquid absorbing layer 4 for absorbing the liquid type foreign material or humor, and the liquid transmission prevention layer 5 which is disposed in the downstream side of the inhaled air relative to the liquid absorbing layer 4 and prevents the liquid type foreign material absorbed by the liquid absorbing layer 4 from flowing or permeating to the mouth of the wearer.

While the invention has been explained with reference to the specific embodiments of the invention, the explanation is illustrative and the invention is limited only by the appended claims.

What is claimed is:

1. A mask for preventing passage of a liquid foreign material for a wearer, comprising:

a liquid absorbing layer for absorbing a liquid foreign material applied thereto, said liquid absorbing layer being formed of fibers having an average diameter from 1.0 $\mu$m to 2.0 $\mu$m, a weight per area from 15 g/m$^2$ to 25 g/m$^2$, and a space in a cubic unit of 90% or more, and a liquid transmission prevention layer disposed on the liquid absorbing layer at a downstream side of air flowing through the mask and formed of a gigged non-woven fabric having a base layer and a number of gigged hairs formed at one side of the base layer, said liquid transmission prevention laver being disposed to allow the gigged hairs to contact the liquid absorbing layer for reducing an area of contact of the liquid transmission prevention layer with the liquid absorbing layer so as to prevent the liquid foreign material absorbed in the liquid absorbing layer from permeating into the liquid transmission prevention layer so that said liquid transmission prevention layer prevents the liquid foreign material absorbed by the absorbing layer from contacting the wearer and allows air to pass smoothly.

2. A mask according to claim 1, wherein said liquid absorbing layer has a thickness from 0.2 mm to 0.5 mm, and the space in a cubic unit less than 98%.

3. A mask according to claim 1, further comprises a first layer disposed on a front surface of the liquid absorbing layer at a side away from the wearer, and a second layer disposed on the liquid transmission prevention layer and directly contacting the wearer.

4. A mast according to claim 1, wherein said gigged non-woven fabric is made of bicomponent fibers including polypropylene.

* * * * *